US012235049B2

(12) United States Patent
Enomura

(10) Patent No.: US 12,235,049 B2
(45) Date of Patent: Feb. 25, 2025

(54) HEAT EXCHANGER

(71) Applicant: M. Technique Co., Ltd., Izumi (JP)

(72) Inventor: Masakazu Enomura, Izumi (JP)

(73) Assignee: M. TECHNIQUE CO., LTD., Izumi (JP)

( * ) Notice: Subject to any disclaimer, the term of this patent is extended or adjusted under 35 U.S.C. 154(b) by 195 days.

(21) Appl. No.: 17/783,111

(22) PCT Filed: Dec. 20, 2019

(86) PCT No.: PCT/JP2019/050216
§ 371 (c)(1),
(2) Date: Jun. 7, 2022

(87) PCT Pub. No.: WO2021/124582
PCT Pub. Date: Jun. 24, 2021

(65) Prior Publication Data

US 2023/0020370 A1 Jan. 19, 2023

(51) Int. Cl.

| | |
|---|---|
| ***F28D 7/02*** | (2006.01) |
| ***F28F 9/00*** | (2006.01) |
| ***F28F 19/02*** | (2006.01) |

(52) U.S. Cl.
CPC ..... *F28D 7/02* (2013.01); *F28F 9/001* (2013.01); *F28F 19/02* (2013.01)

(58) Field of Classification Search
CPC .... F28F 19/02; F28F 9/001; F28F 7/10; F28F 7/02; F28F 7/026
See application file for complete search history.

(56) References Cited

U.S. PATENT DOCUMENTS 4,657,711 A * 4/1987 Wigley ..... F28F 25/087 261/112.2
2015/0159958 A1 6/2015 Kimura
2019/0352781 A1* 11/2019 Poteet ..... C23C 16/45525

FOREIGN PATENT DOCUMENTS

JP 54-42157 U 3/1979
JP 2002-147976 A 5/2002
JP 2006-250524 A 9/2006
(Continued)

OTHER PUBLICATIONS

International Search Repori (PCT/ISA/210) issued in PCT/JP2019/050216 mailed on Feb. 10, 2020.

*Primary Examiner* — Devon Russell
(74) *Attorney, Agent, or Firm* — Birch, Stewart, Kolasch & Birch, LLP

(57) ABSTRACT

A heat exchanger with which a fluid to be treated or a generated gas can be prevented from stagnating in a heat transfer part, which can be disassembled for good washability, and which can be coated or lined. The heat exchanger is provided with tow flow passages, i.e. a first flow passage and a second flow passage, within a space formed between an inner tube and an outer tube which are concentric to each other. A spiral heat transfer body is disposed between the inner tube and the outer tube, and the spiral heat transfer body has a cross-sectional shape that is substantially triangular in the axial-direction cross section. The space is partitioned into the first flow passage and the second flow passage by the spiral heat transfer body, and heat is exchanged via the spiral heat transfer body between a first fluid flowing within the first flow passage and a fluid flowing within the second flow passage.

19 Claims, 4 Drawing Sheets

(56) References Cited

FOREIGN PATENT DOCUMENTS

| | | | | |
|---|---|---|---|---|
| JP | 2007-93142 | A | | 4/2007 |
| JP | 2007139404 | A | * | 6/2007 |
| JP | 2013-24536 | A | | 2/2013 |
| JP | 2015-81716 | A | | 4/2015 |
| JP | 2016-102643 | A | | 6/2016 |
| JP | 2019-7649 | A | | 1/2019 |
| KR | 10-2015-0020578 | A | | 2/2015 |

* cited by examiner

HEAT EXCHANGER

TECHNICAL FIELD

The present invention relates to a heat exchanger to heat or cool a liquid, especially a fluid that includes a slurry having a solid substance dispersed therein, a highly viscous liquid, a vapor, or the like, by using a fluid such as a cooling medium, a heating medium, or a steam.

BACKGROUND ART

In the processes for manufacturing chemicals and foods as well as in the manufacturing processes of a toner, an inkjet, and the like, there are many requirements such as rapid cooling and rapid heating. In addition, there are requirements to make a space necessary for installing the equipment thereof as small as possible and to reduce the size thereof as well; therefore, it is required to improve the performance of a heat exchanger. Further, the heat exchanger is required to be less adhesive, and to have good washability, high pressure resistance and corrosion resistance, and to be a low in cost.

In the past, as disclosed in Patent Document 1, a heat exchanger is known such that a coiled heat transfer tube is arranged in a space formed between an inner tube and an outer tube, inside of the heat transfer tube is made as one flow path, and a coil-shaped space sandwiched by the heat transfer tubes is made as another flow path thereby realizing an efficient heat transfer between one fluid and the other fluid.

In the heat exchanger described in Patent Document 1, reduction in the size and improvement in the performance could be realized; but the space between the coiled heat transfer tube having a circular cross sectional shape and the inner peripheral surface of the outer tube or the outer peripheral surface of the inner tube is inevitably narrow, so that not only clogging and adhesion are likely to occur in this narrow portion but also even when the inner tube and the outer tube are separated, a narrow portion still exists unless the coiled heat transfer tube is separated. Therefore, when the adhesion or the like occurs in this narrow portion, not only washing thereof is difficult but also the washing state such as whether or not this portion is cleaned cannot be readily confirmed. In addition, it is practically impossible to apply a coating or lining to inside of the coiled heat transfer tube; besides, in view of the structure thereof, it is difficult to apply coating or lining with a corrosion resistant material in other flow path, so that the improvement is required from a viewpoint of the corrosion resistance. In particular, it is practically impossible to apply coating or lining inside of the heat transfer tube with a corrosion resistant material; and even if this could be applied, it is inevitably non-practical in view of the production cost because of poor mass productivity thereof.

When the heat exchange is conducted with the heating medium that flows through the heat transfer tube by flowing a slurry including microparticles in the coil-shaped space sandwiched by the heat transfer coils in the space formed between the inner tube and the outer tube, there is the case that the slurry remains in the coil-shaped space, which is the space between the heat transfer tubes; and when the heat exchange is accompanied with evaporation, the vapor thereof remains in the heat transfer portion and inhibits the heat exchange, namely, that causes a dry-out.

Patent Document 2 describes the heat exchanger in which a liquid-side heat transfer tube having a cross sectional shape of a substantially triangle is formed into coiled-shape, and in the outer periphery thereof, a cooling medium-side heat transfer tube is arranged in a coiled-shape, and then, the liquid-side heat transfer tube and the cooling medium-side heat transfer tube are joined. However, in this heat exchanger, the heat transfer area is too small and is specialized for a water heater and the like; therefore, reduction in the size, washability, improvement in the performance, and reduction in the cost could not be realized yet.

Patent Document 3 describes the heat exchanger having a first flow path-forming member that has a container shape and a second flow path-forming member that is detachably disposed to the first flow path-forming member in the inner side of the first flow path member, wherein the first flow path-forming member has the diameter of the inner peripheral surface of the peripheral inner wall portion of container shape which gradually narrows from upper part to lower part, and a first flow path through which a liquid for heat exchange is flowed is formed in the peripheral wall portion, and between the inner peripheral surface of the first flow path-forming member and the outer peripheral surface of the second flow path-forming member, a spiral second flow path through which the liquid for heat exchange and a liquid to be heat-exchanged by the inner peripheral surface and the outer peripheral surface are flowed is formed.

However, because the flow rate on the heat-transfer surface changes gradually due to gradual narrowing of the flow path, it is difficult to apply this equipment to in general industry; in addition, in the case of heat exchange accompanied with boiling, there are many stagnating portions of a generated gas thereby readily causing the dry-out trouble.

PRIOR ART DOCUMENTS

Patent Document

Patent Document 1: Japanese Patent Unexamined Application Publication No. 2002-147976

Patent Document 2: Japanese Patent Unexamined Application Publication No. 2013-24536

Patent Document 3: Japanese Patent Unexamined Application Publication No. 2015-81716

DISCLOSURE OF INVENTION

Problems to be Solved by the Invention

Under the circumstances described above, an object of the present invention is to provide a heat exchanger having a structure suitable for suppressing the retention of a fluid to be processed or a generated gas in a heat transfer portion.

Another object of the present invention is to provide a heat exchanger having good washability.

Still another object of the present invention is to provide a heat exchanger that can be decomposable.

Still another object of the present invention is to provide a heat exchanger capable of applying coating or lining.

Means for Solving the Problems

According to the present invention, a heat exchanger is provided with two flow paths of a first flow path and a second flow path, which spirally circulate in a space formed between an inner tube and an outer tube in which they are concentrically arranged, and a heat exchange is performed between a first fluid flowing through the first flow path and a second fluid flowing through the second flow path via a heat transfer body, wherein the heat transfer body is spirally circulated and has a cross sectional shape of an substantially triangle in an axial-direction cross-sectional view; and the space is partitioned into the first flow path and the second flow path by the heat transfer body, and the heat exchange is performed via the heat transfer body.

According to the present invention, a heat exchanger is provided with a heat transfer body that is spirally circulated in a space formed between an inner tube and an outer tube in which they are concentrically arranged, the space being partitioned into a first flow path and a second flow path by the heat transfer body, a heat exchange is performed between a first fluid flowing through the first flow path and a second fluid flowing through the second flow path via the heat transfer body, wherein the inner tube, the outer tube, and the heat transfer tube are detachably assembled on a side of the outer tube and a side of the inner tube; in the state of being separated into the side of the outer tube and the side of the inner tube, a flow path constitution surface defining the first flow path is separated into the side of the outer tube and the side of the inner tube, and all surfaces of the flow path constitution surfaces that define the first flow path are configured so as to be directly exposed without being hidden by any other portion when viewed from the radius direction, which is perpendicular to the axial direction.

It is appropriate that at least any one of the inner tube and the outer tube is a circular cylinder in an axial-direction cross-sectional view thereof. By so doing, a countercurrent flow of spiral flow can be generated in the first fluid flowing through the first flow path which is defined by the heat transfer body having the substantially triangular shape in the cross-sectional view thereof and the inner tube or the outer tube.

In addition, it is appropriate that a ratio ($\lambda/\mu$) of a maximum flow path width ($\lambda$) of the first flow path to a minimum flow path width ($\mu$) of the first flow path in a radius direction is preferably 2 or more ($2<\lambda/\mu<\infty$). By so doing, the flow toward a spiral direction in the inner tube or the outer tube can be made greater than the flow toward an axial direction; thus, as a whole, the flow direction of the first fluid can be made toward the spiral direction.

In addition, the present invention may be carried out such that the heat transfer body is fixed to any one side of the outer tube and the inner tube, and not to any other side of the outer tube and the inner tube, and the heat transfer body has a sterically shaped portion having at least one bending portion and capable of forming a space through which fluids can flow in both the inner surface side and the outer surface side thereof; and an exterior angle of all bending portions in the flow path constitution surface that defines the first flow path is 90 degrees or greater.

In addition, the present invention may be carried out such that in the heat transfer body, the first flow path and the second flow path are not provided with a horizontal portion that may retain the first fluid and the second fluid.

In addition, the present invention may be carried out such that the first flow path and the second flow path are spirally circulated, and there is either no gap or there is a gap of 4 mm or less in a radius direction between the circulations adjacent to each other in an axial direction.

In addition, the present invention may be carried out such that in an axial-direction cross-sectional view of the first flow path and the second flow path, a cross sectional shape thereof is a substantially triangle whose apex angle $\theta$ is in the range of 30 degree or more and 125 degree or less.

In addition, the present invention may be carried out such that the side of the inner tube and the side of the outer tube are assembled so as to be separatable by only moving in an axial direction without rotating, and the heat transfer body is configured not to interfere with other portion when moving in the axial direction.

In addition, the present invention may be carried out such that in the first flow path and the second flow path, a cross sectional shape thereof in an axial-direction cross-sectional view is a substantially triangle including two slopes, a bottom surface, and a peak portion; and an axial-direction length (a) of the peak portion is shorter than an axial-direction length (b) of the slope.

In addition, the present invention may be carried out such that the peak portion of at least any one of the first flow path and the second flow path has length (a) in the axial-direction so that a cross-section area of the flow path is increased as compared to the case where the peak portion has no length (a) in the axial-direction.

In addition, the present invention may be carried out such that there is a plurality of the concentric spaces formed between the inner tube and the outer tube that are concentrically arranged.

In addition, the present invention may be carried out such that at least any one of a passing flow path including the first flow path, through which the first fluid flows, and a passing flow path including the second flow path, through which the second fluid flows, is coated with a corrosion resistant material, and it is preferable that the coating with the corrosion resistant material be one of a glass lining, a fluorine resin coating, and a ceramic coating.

Advantages

The present invention could provide the heat exchanger having the structure suitable for suppressing retention of a fluid to be processed or a generated gas in the heat transfer portion thereof.

The present invention could provide the heat exchanger having good washability.

The present invention could provide the heat exchanger having the structure that can be easily decomposable.

The present invention could provide the heat exchanger capable of applying a coating or lining.

To describe more specifically, in the processes for manufacturing chemicals and foods as well as in the manufacturing processes of a tonner, an inkjet, and the like, there are many requirements such as those for rapid cooling and rapid heating; in addition, the object, namely the fluid to be processed, includes a lot of a highly viscous liquid, a slurry containing microparticles, and adhering substances. In the case that a heating operation accompanied with evaporation is conducted by using a heat exchanger, when a generated gas retains, the thermal conductivity thereof drops to the almost same low level as the single-phase flow of the generated gas. This phenomenon is called a dry-out phenomenon in which a liquid film flowing along the heat transfer surface disappears by evaporation thereby causing a gas phase thereof by directly contacting with the heat transfer surface. In addition, the heat exchanger must be scaled up without fail; thus, not only a high performance, but also it must be processed as calculated even when the size thereof is large.

In order to solve these problems, the relationship between the flow rate of the fluid to be processed and the pressure loss was reconsidered; and as a result, the present invention could provide the heat exchanger having the structure that even if the flow rate of the fluid to be processed is increased, the pressure loss does not become too large. This effect is large especially when the fluid to be processed is a highly viscous liquid or the slurry that readily precipitates, which results in decrease of dirt and adhesion.

In addition, by making the cross-sectional shape of the heat transfer body a substantially triangle, the retention of liquid and the generated gas does not exist, and the heat transfer area can be made large. Accordingly, there is a flexibility of design that the substantially triangle is selected as the cross-sectional shape of the heat transfer body from the physical properties of the fluid to be processed.

In addition, because the held amount of the fluid to be processed is small, heating or cooling can be rapidly handled, and at the same time the held amount of the heating medium or cooling medium is also small, reduction in the size of the equipment, improvement in the performance, and easy control could be realized.

Because the structure thereof is very simple, thus it can be readily assembled and disassembled, as well as can be coated or lined with a corrosion resistant material.

BEST MODES FOR CARRYING OUT THE INVENTION

Hereinafter, with reference to the drawings, a heat exchanger according to each of the embodiments of the present invention will be described. In this specification, the center lines described in FIG. 2 and FIG. 4A to FIG. 4F indicate the axial direction.

(Fluid to be Heat-Exchanged)

In the embodiments, for the sake of explanation, the fluid for which heat exchange is performed will be described as a first fluid F1. Because the heat exchange is conducted in order to exchange a heat energy between two fluids, there is no need to distinguish them as a major fluid and a minor fluid; but, in general, the heat exchange is mostly conducted for purpose of heating and cooling process to one specific fluid. Therefore, in the embodiments, the fluid to be processed for subjecting heating or cooling process will be explained as a first fluid F1. The fluid that conducts the heat exchange with the first fluid F1 will be explained as a second fluid F2. Further, other fluid that conducts the heat exchange with the first fluid F1 will be explained as a third fluid F3.

As illustrative examples of the first fluid F1, various fluids such as a gas, a liquid, a slurry, and a highly viscous liquid may be included. As illustrative examples of the second fluid F2 and the third fluid F3, heat media such as a steam, a hot water, a cold water, and a nitrogen gas may be included. However, the types of these fluids should not be considered as a specific type of fluid; thus, the first fluid F1 may be the heat medium, and the second fluid F2 and the third fluid F3 may be used as the fluids for heat exchange.

Outline of the First Embodiment

Figure 1:
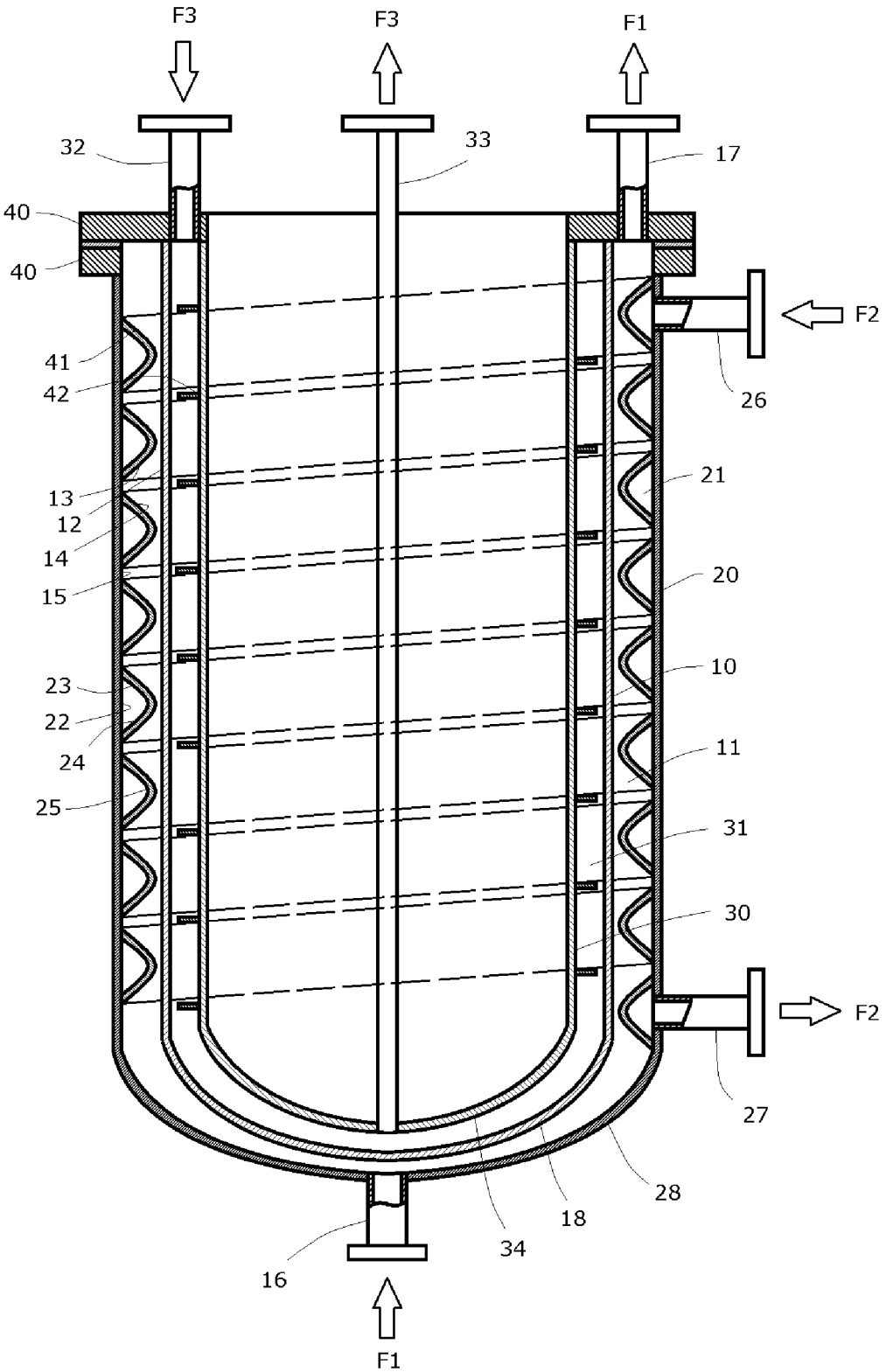
FIG. 1 is a cross-sectional view in vertical direction of a heat exchanger according to a first embodiment of the present invention.

The heat exchanger according to the first embodiment as shown in FIG. 1 includes an inner tube 10 and an outer tube 20 that are concentrically arranged, and as needed, with a third cylinder 30 that is concentrically arranged further inside of the inner tube 10.

A heat transfer body 41 is arranged on the inner peripheral surface of the outer tube 20 so as to be spirally circulated.

A space between the inner tube 10 and the outer tube 20 is partitioned into two spaces by the heat transfer body 41. Of the two spaces thus partitioned, the space in the inner side (inner side in the radius direction) of the heat transfer body 41 constitutes a first flow path 11, which is the flow path of the first fluid F1; and of the two spaces thus partitioned, the space in the outer side (outer side in the radius direction) of the heat transfer body 41 constitutes a second flow path 21, which is the flow path of the second fluid F2.

The heat transfer body 41 is fixed to the inner peripheral surface of the outer tube 20 by welding or the like in the state of maintaining an air tightness and a liquid tightness, accordingly, the space between the inner tube 10 and the outer tube 20 is partitioned into the first flow path 11 and the second flow path 21 so as not to mix the first fluid F1 and the second fluid F2; and the first flow path 11 and the second flow path 21 become the spirally circulated flow paths. The heat exchange is performed between the first fluid F1 and the second fluid F2 via the heat transfer body 41.

Figure 2:
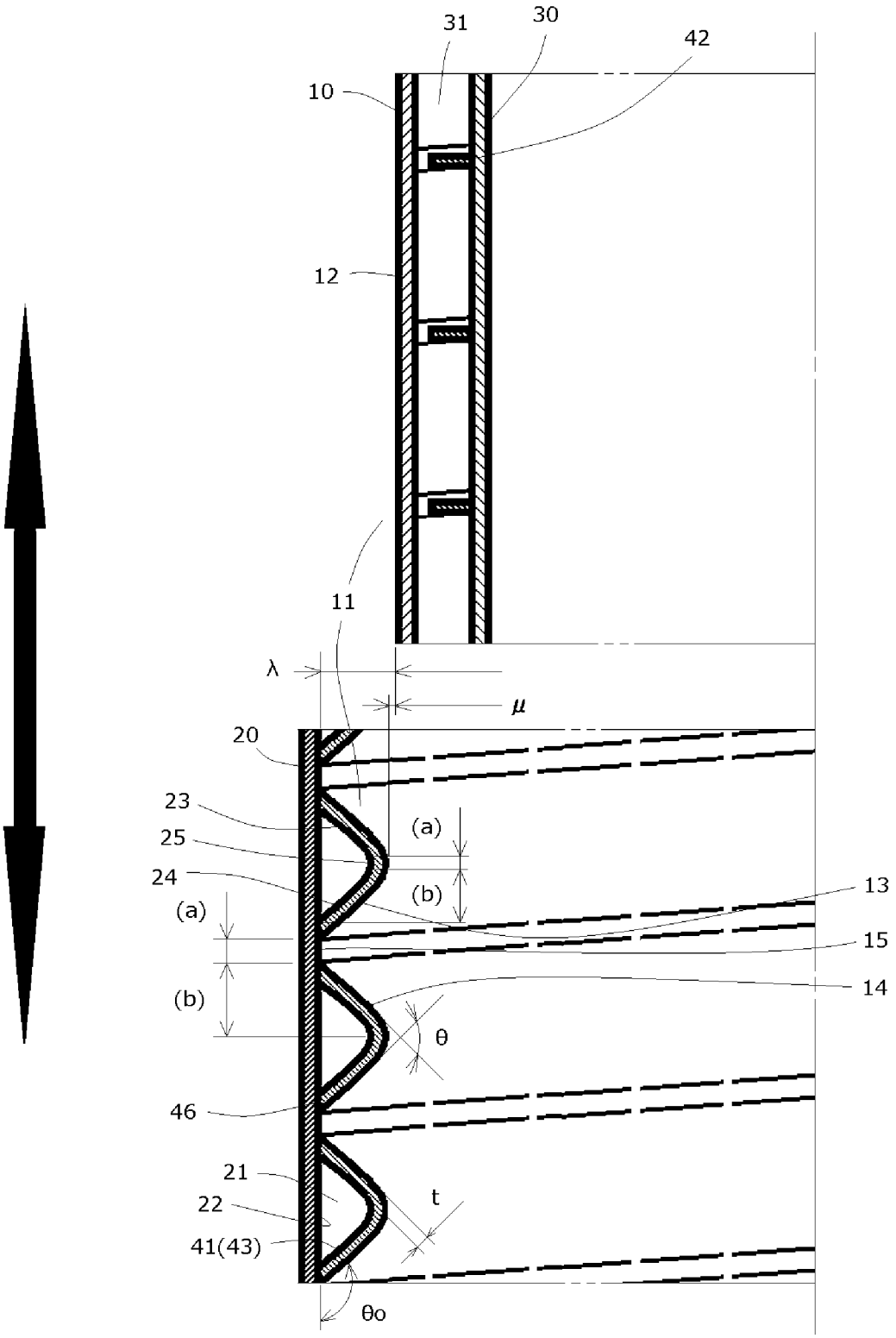
FIG. 2 is an enlarged cross-sectional view of the essential part in the state that an inner tube and an outer tube in FIG. 1 are separated.

The inner tube 10 and the outer tube 20 are assembled detachably; and as shown in FIG. 2, under the state of being separated, the heat transfer body 41 is separated together with the outer tube 20 from the inner tube 10. Under this separated state, a flow path constitution surface that defines the first flow path 11 is separated into the side of the inner tube 10 and the side of the outer tube 20.

Further, in this example, the space between the inner tube 10 and the third cylinder 30 constitutes a third flow path 31 for the third fluid F3; and a heat exchange is performed between the first fluid F1 and the third fluid F3 via the inner tube 10. In this configuration, since a flow path body 42 is spirally circulated and is fixed to the outer peripheral surface of the third cylinder 30, the third flow path 31 also becomes a spirally circulated flow path.

(Fixing and Separation of Cylinders)

The inner tube 10, the outer tube 20, and the third cylinder 30 are fixed by a flange portion 40 at an upper end of the cylinders so as to be separable from each other. In this example, two flange portions 40 are overlapped with a sealing member sandwiched therebetween and, they are detachably assembled and integrated by a detachable fixing member such as a bolt (not shown). The upper ends of the inner tube 10 and the third cylinder 30 are fixed (detachably, as necessary) to the upper flange portion 40, and the upper end of the outer tube 20 is fixed (detachably, as necessary) to the lower flange portion 40; by separating the upper and lower flange portions 40 and 40, the inner tube 10 and the outer tube 20 can be separated from each other. In addition, at least any one of the inner tube 10 and the third cylinder 30 is made detachable from the upper flange portion 40, whereby the inner tube 10 and the third cylinder 30 can also be separated from each other.

As described above, the heat transfer body 41 is fixed to the inner peripheral surface of the outer tube 20 by welding or the like. Accordingly, when the heat exchanger is taken apart by disassembling the fixing of the flange portion 40, this is separated into the outer tube 20 in which the heat transfer body 41 is fixed to the inner peripheral surface thereof, the inner tube 10, and the third cylinder 30 having the flow path body 42 in the outer peripheral surface thereof. At this time, the outer tube 20 to which the heat transfer body 41 is attached can be pulled out downward together with the lower flange portion 40 because there is no interference against the heat transfer body 41.

(With Regard to the Heat Transfer Body 41)

The heat transfer body 41 advances in the axial direction between the inner tube 10 and the outer tube 20 while spirally circulating, therefore the cross-sectional shape thereof in the axial-direction cross-sectional view is a substantially triangle, as shown in FIG. 1 and FIG. 2. In this embodiment, the heat transfer body 41 is fixed to the inner peripheral surface of the outer tube 20 by welding or the like.

As the apex angle θ of the substantially triangle in the axial-direction cross-sectional view of the heat transfer body 41 increases, the cross-section areas (flow path areas) of the first flow path 11 and the second flow path 21 increase, while the number of the spiral circulation per the certain length unit in the inner tube 10 and the outer tube 20 in the axial direction decreases. Also, as the apex angle θ departs more from 90 degrees, the narrow portions in the first flow path 11 and the second flow path 21 increase, so that risk of clogging the fluid increase. Therefore, considering these aspects, the apex angle θ is appropriately in the range of 30 degrees or more to 125 degrees or less.

On the other hand, the exterior angle (360-θ) to the apex angle θ of the substantially triangle is 90 degrees or greater, while appropriately in the range of 235 degrees or more to 330 degrees or less.

In the mathematical sense, the triangle has two hypotenuses intersect with each other at the apex; but when presupposing the industrial production thereof such as processing of a metal plate, in general, the apex thereof is rounded, or has an axial-direction length of the cross-sectional shape thereof. Therefore, it must be understood that the term "substantially triangle" includes not only the mathematical triangle but also the shapes with presupposition of industrial production thereof. Accordingly, it must be understood that the apex angle θ of the substantially triangle means not only the intersection point of the two hypotenuses but also the intersection points of the extended lines thereof. In the case of the cross-sectional shape having the axial-direction length, as the axial-direction length increases, the risk that the first fluid F1 is clogged between the heat transfer body 41 and the outer peripheral surface of the inner tube body 10 increases; the axial-direction length is appropriately shorter than the axial-direction length of one hypotenuse.

Because the heat exchange is performed between the first fluid F1 and the second fluid F2 via the heat transfer body 41, in view of the efficiency of the heat exchange, the thickness t of the heat transfer body 41 is preferably in the range of 0.2 mm to 3 mm, while more preferably in the range of 0.5 mm to 2 mm. The thicknesses of the inner tube 10, the outer tube 20, and the third cylinder 30 may be the same as the above-mentioned thickness. Here, however, the thicknesses thereof are not limited to this range; they may be modified in view of the strength in which the inner tube 10, the outer tube 20, and the third cylinder 30 work as the structural body.

The heat transfer body 41 may also be said which is composed of a sterically shaped portion 43 having at least one bending portion (this includes not only the portion in which a straight line is bent with an angle but also the portion that is curved like an arc). The sterically shaped portion 43 has at least one bending portion and has the shape capable of forming the spaces (the first flow path 11 and the second flow path 21) in which fluids can be flowed in both the inner surface side and the outer surface side thereof. Specifically, the sterically shaped portion 43 is a long body having the shape like a polygonal square tube or a tube divided along the axial direction thereof; in this example, the sterically shaped portion 43 is a long body having the shape like the one that a square tube is divided on the diagonal line of its square cross section along the axial direction. The sterically shaped portion 43 is wounded around the inner peripheral surface of the outer tube 20, and upper and lower end sides 46 thereof are fixed to the inner peripheral surface of the outer tube 20. The exterior angle $\theta_0$ formed by the sterically shaped portion 43 and the inner peripheral surface of the outer tube 20 in each of the upper and lower end sides 46 is appropriately 90 degrees or greater, while more preferably $105 \leq \theta_0 \leq 160$. Here, when the sterically shaped portion 43 in the end sides 46 is curved, the angle is formed by the tangential lines thereof and the inner peripheral surface of the outer tube 20.

The exterior angle of the bending portion in the sterically shaped portion 43 means the exterior angle (360-θ) to the apex angle θ of the substantially triangle and the exterior angle $\theta_0$ formed by the sterically shaped portion 43 and the inner peripheral surface of the outer tube 20 in each of the upper and lower end sides 46.

(With Regard to the First Flow Path 11)

The first flow path 11 constitutes the flow path having the cross-sectional shape of the substantially triangle and is the space between the heat transfer body 41 that is spirally circulated on the inner peripheral surface of the outer tube 20 and the outer peripheral surface of the inner tube 10; and the first flow path 11 is the flow path of the first fluid F1, which is the main subject to perform heat exchange.

The first flow path 11 is defined by a bottom surface 12 formed by the outer peripheral surface of the inner tube 10, two slopes of a first slope 13 and a second slope 14, and a peak portion 15 formed between the first slope 13 and the second slope 14. The peak portion 15 is composed of the inner peripheral surface of the outer tube 20, and this portion is the space between the spiral circulations of the heat transfer body 41 in the axial direction. The space between the spiral circulations of the heat transfer body 41 are created by the flight of the heat transfer body 41 being spaced from each other, thereby exposing a part of the outer tube to the first flow path 11. Here, when the heat transfer body 41 is made dense spiral shape so as not to generate a space in the axial direction, the peak portion 15 becomes a dotty peak point having no length in the axial-direction cross sectional shape.

In this embodiment, the inner tube 10 is a circular cylindrical body in the axial-direction cross-sectional view; and the outer peripheral surface thereof is a cylindrical outer peripheral surface without unevenness. Further, in this example, the outer tube 20 is also a circular cylindrical body in the axial-direction cross-sectional view; and the inner peripheral surface thereof is a cylindrical inner peripheral surface without evenness.

When the axial-direction length (a) of the peak portion 15 is increased, the cross-section area (flow path area) of the first flow path 11 can be increased, however, since the area of the heat transfer body 41 directly related to the heat exchange does not change even when the length (a) is increased, there is a risk that the entire heat transfer efficiency thereof decreases. Therefore, it is preferable that the axial-direction length (a) of the peak portion 15 be shorter than the axial-direction length (b) of the slope 13 and the slope 14.

The first slope 13 and the second slope 14 are appropriately linear in the axial-direction cross sectional view, but they may be curved lines such as an arch shape or the like. However, it is preferable that the flow paths having substantially triangular cross-sectional shape (the first flow path 11 and the second flow path 21) have the shape in which the fluids to be processed, i.e., the first fluid F1 and the second fluid F2, or a gas is unlikely to accumulate. For example, it is preferable to avoid providing a flat horizontal portion or a depression portion in a part of the flow path unless there is a special purpose.

In this example, as shown in FIG. 2, a gap (μ) is provided in the base portion side of the substantially triangle in the axial-direction cross-sectional view that constitutes the first flow path 11. In other words, a space is provided between the end portion in the inner peripheral side of the first slope 13 and the bottom surface 12, and a space is provided between the end portion in the inner peripheral side of the second slope 14 and the bottom surface 12. It may be carried out without providing this gap (μ), but when the gap (μ) is provided, it is appropriate to set it to 4 mm or less. In still other words, in the spirally circulated first flow path 11, the gap (μ) is provided between circulations adjacent to each other in the axial direction, namely, between the substantially triangular cross-sectional shape and the substantially triangular cross-sectional shape which are adjacent to each other in the axial direction. It may be carried out without providing this gap (μ), but when the gap (μ) is provided, it is appropriate to set it to 4 mm or less.

By providing this gap (μ), the outer tube 20 and the inner tube 10 can be readily separated upon disassembling the heat exchanger. When the gap is too large, however, the amount of the fluid in which the first fluid F1 does not spirally flow but flows in a short pass in the axial direction increases, so that the efficiency of the heat exchange may be decreased.

It can be understood that the gap (μ) is the maximum flow path width (μ) of the first flow path 11 in the radius direction, and that the length between the peak portion 15 and a bottom portion 18 of the first flow path 11 defines the maximum flow path width (λ) of the first flow path 11 in the radius direction. Here, the ratio (λ/μ) of the maximum flow path width (λ) to the minimum flow path width (μ) of the first flow path 11 is appropriately 2 or more, while preferably 10 or more. When there is no gap μ(in other words, when the heat transfer body 41 and the inner tube 10 are in contact with each other), this means $\mu=0$, i.e., $\lambda/\mu=\infty$.

Note that explanation about the heat transfer body 41 such as the apex angle θ of the substantially triangle in the axial-direction cross-sectional view is also applied to the first flow path 11.

It is expected that various fluids such as a gas, a liquid, a slurry, and a highly viscous liquid flow in the first flow path 11 as the first fluid F1. At this time, depending on the type of the fluid, a highly viscous substance or a slurry easily precipitate may adhere to the first flow path 11. In this embodiment, however, since the first flow path 11 has the substantially triangle shape in the axial-direction cross-sectional view and has no narrow portion that has a dead end, so that the first flow path 11 has the structure such that the generation of adhesion of a highly viscous substance or a slurry easily precipitate can be suppressed.

Also, upon disassembling for cleaning, when the inner tube 10 and the outer tube 20 are separated, not only the outer peripheral surface of the inner tube 10 is exposed, but also the entire heat transfer body 41 having the substantially triangular cross-sectional shape in the axial-direction is exposed together with the inner peripheral surface of the outer tube 20.

In other words, the flow path constitution surface defining the first flow path 11 is, in the side of the outer tube 20, the inner peripheral surface of the outer tube 20 in the radius direction and the surface of the inner side of the heat transfer body 41 in the radius direction, and in the side of the inner tube 10, the outer peripheral surface of the inner tube 10. Therefore, all surfaces thereof are configured so as to be directly exposed without being hidden by any other portion viewed from the radius direction, which is perpendicular to the axial direction.

Accordingly, not only the first flow path 11 can be cleaned in every corner, but also it is easy to confirm the state after completion of the cleaning. On the other hand, in the heat exchanger described in Patent Document 1, the space between the coiled heat transfer tube having a circular cross-sectional shape and the inner peripheral surface of the outer tube or the outer peripheral surface of the inner tube is inevitably narrow; and in addition, even when the inner tube and the outer tube are separated, unless the coiled heat transfer body is separated, a half of the backside of the coiled heat transfer tube, when viewed from the radius direction, is not directly exposed because of being hidden by a half of the frontside thereof. Accordingly, not only the cleaning in every corner is difficult but also it is not easy to confirm the cleaning state.

The material of each surface that defines the flow path of the first fluid F1 such as the first flow path 11 may be selected in accordance with the types of the first fluid F1 such as metal. In addition, it is preferable that the surface thereof be coated with a corrosion resistant material. Illustrative examples of the coating with a corrosion resistant material include a glass lining, a fluorine resin coating, and a ceramic coating. At this time, after the heat transfer body 41 is fixed to the inner peripheral surface of the outer tube 20 by welding or the like, when this is coated with a corrosion resistant material as well as the outer peripheral surface of the inner tube 10 is similarly coated, and then, the inner tube 10 is inserted into the outer tube 20 for assemble, the entire inner surface of the first flow path 11, i.e., the entire flow path constitution surface that defines the first flow path 11 can be reliably coated.

(With Regard to the Second Flow Path 21)

The space outside of the heat transfer body 41 in the radius direction (in other words, the space between the heat transfer body 41 and the inner peripheral surface of the outer tube 20) constitutes the second flow path 21 having the substantially triangular cross-sectional shape in the axial-direction. The second flow path 21 is defined by a bottom surface 22 composed of the inner peripheral surface of the outer tube 20, two slopes of a first slope 23 and a second slope 24, and a peak portion 25 between the first slope 23 and the second slope 24. The peak portion 25 may be a dot-like apex having no length in the vertical-direction cross sectional shape, or may be a linear or curved peak portion having a length in the axial-direction cross sectional shape. When the peak portion 25 is the linear or curved peak portion having a length in the axial direction cross-sectional shape, it is preferable that an axial-direction length (a) of the peak portion 25 be shorter than an axial-direction length (b) of the slopes 23 and 24. It is appropriate that the first slope 23 and the second slope 24 are linear in the axial-direction cross sectional view; but each of them may be a curved line such as an arch shape.

Note that, explanation about the apex angle θ of the substantially triangle in the axial-direction cross-sectional view and so forth of the heat transfer body 41 is also applied to the second flow path 21.

Contrary to the first flow path 11, the second flow path 21 is a closed space in the axial-direction cross-sectional view, so that when the inner tube 10 and the outer tube 20 are only separated, the closed state is maintained. However, since a heat medium such as a steam, a hot water, a cold water, and a nitrogen gas is passed through the second flow path 21 as the second fluid F2, the adhesion of the fluid or the like barely occurs on contrary to the first flow path 11.

(With Regard to the Third Flow Path 31)

A plate-like flow path body 42 extending spirally is fixed to the outer peripheral surface of the third cylinder 30 by welding or the like, whereby the third flow path 31 becomes a spiral space. The circulation direction of the third flow path 31 may be the same as the circulation direction of the first flow path 11 and the second flow path 21, or may be different (for example, clockwise or counterclockwise direction).

In the third flow path 31, unless the inner tube 10 and the third cylinder 30 are separated, the enclosed state thereof is maintained. However, since a heat medium such as a steam, a hot water, a cold water, and a nitrogen gas is passed through the third flow path 31 as the third fluid F3, the adhesion of the fluid or the like barely occurs on contrary to the first flow path 11.

(With Regard to the Inflow portion and the Outflow Portion)

The inner tube 10, the outer tube 20, and the third cylinder 30 each are provided with the bottom portion 18, a bottom portion 28, and a bottom portion 34, respectively; these portions having a dome-like shape. The space between the bottom portion 18 of the inner tube 10 and the bottom portion 28 of the outer tube 20 is connected to a lower portion of the spiral first flow path 11, and the space between the bottom portion 18 of the inner tube 10 and the bottom portion of the third cylinder 30 is connected to a lower portion of the spiral third flow path 31.

In the first flow path 11 in FIG. 1, the lower end thereof is connected to an outer flow path via an inflow portion 16. In this example, the inflow portion 16 is provided such that a connecting pipe is attached to a penetrating hole that is open to the bottom portion 28 of the outer tube 20. The upper end of the first flow path 11 is connected to an outer flow path via an outflow portion 17. In this example, the outflow portion 17 is provided such that a connecting pipe is attached to a penetrating hole that is open to the flange portion 40. The first fluid F1 flows from the inflow portion 16 into the spiral first flow path 11 and moves upward while spirally circulating, and then flows out to outside through the outflow portion 17.

The upper end of the second flow path 21 is connected to an outer flow path via an inflow portion 26. In this example, the inflow portion 26 is provided such that a connecting pipe is attached to a penetrating hole that is open to the outer tube 20. The lower end of the second flow path 21 is connected to an outer flow path via an outflow portion 27. In this example, the outflow portion 27 is provided such that a connecting pipe is attached to a penetrating hole that is open to the outer tube 20. The second fluid F2 flows from the inflow portion 26 into the spiral second flow path 21 and moves spirally downward, and then flows out to outside through the outflow portion 27.

The upper end of the third flow path 31 is connected to an outer flow path via an inflow portion 32. In this example, the inflow portion 32 is provided such that a connecting pipe is attached to a penetrating hole that is open to the flange portion 40. The lower end of the third flow path 31 is connected to an outer flow path via an outflow portion 33. In this example, the outflow portion 33 is provided such that a connecting pipe is attached to a penetrating hole that is open to the center of the bottom portion 34. Here, this connecting pipe is extended in a cylindrical space inside of the third cylinder 30 until its position in the axial direction becomes substantially the same height as the outflow portion 17 of the first flow path 11 and the inflow portion 26 of the second flow path 21. The third fluid F3 flows from the inflow portion 32 into the spiral third flow path 31 and spirally moves downward, and then flows out to outside through the outflow portion 33.

Note that, upon carrying out this embodiment, the inflow portion and the outflow portion of each flow path may be reversed.

The material of each surface that defines the flow paths of the second fluid F2 and the third fluid F3 such as the second flow path 21 and the third flow path 31 may be selected in accordance with the types of the second fluid F2 and the third fluid F3 such as metal. In addition, it is preferable that the surface thereof be coated with a corrosion resistant material. Illustrative examples of the coating with a corrosion resistant material include a glass lining, a fluorine resin coating, and a ceramic coating.

Second Embodiment

Figure 3:
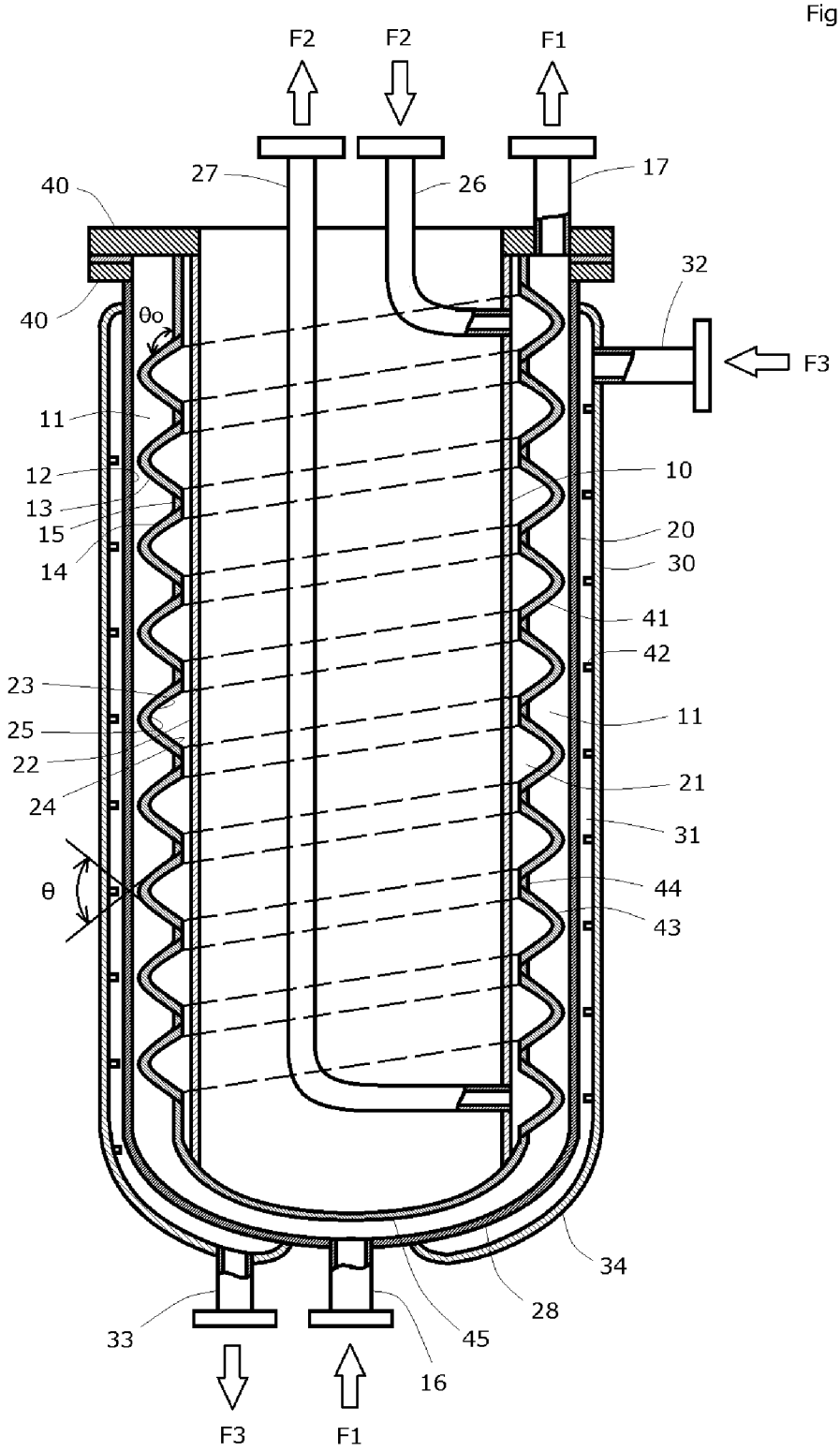
FIG. 3 is a cross-sectional view in vertical direction of a heat exchanger according to a second embodiment of the present invention.

FIG. 3 shows an axial-direction cross-sectional view of a heat exchanger according to a second embodiment. The heat exchanger according to this embodiment is different from the heat exchanger according to the first embodiment in that the third cylinder 30 is arranged outside of the outer tube 20. In the following description, the different points will be mainly explained, and the explanation to the first embodiment is applied to the matters not explained below.

In the heat exchanger according to the second embodiment, three tubes of the inner tube 10, the outer tube 20, and the third cylinder 30 are concentrically arranged toward the outer side in the radius direction. The upper ends of the inner tube 10 and the heat transfer body 41 are attached (detachably as necessary) to the upper flange 40, and the upper end of the outer tube 20 is attached (detachably as necessary) to the lower flange 40; both the flange portions 40 and 40 are joined to each other so as to be separatable into the upper and the lower portions. The upper end of the third cylinder 30 is joined to the outer peripheral surface near the upper end side of the outer tube 20 by welding or the like; and the lower end of the third cylinder 30 is joined to the outer peripheral surface of the bottom portion 28 of the outer tube 20 by welding or the like.

The space in the inner surface side of the heat transfer body 41, in other words, the space between the heat transfer body 41 and the inner tube 10, constitutes the second flow path 21; the space in the outer surface side of the heat transfer body 41, in other words, the space between the heat transfer body 41 and the outer tube 20, constitutes the first flow path 11; and the space between the outer tube 20 and the third cylinder 30 constitutes the third flow path 31.

In the heat transfer body 41, the sterically shaped portions 43 having the cross-sectional shape of the substantially triangle in the axial-direction cross-sectional view are connected to each other and are integrated via a flat-plate like cylindrical portion 44. In other words, the heat transfer body 41 has also cylindrical shape as a whole, and the shape of cylindrical wall surface has an uneven shape including the sterically shaped portion 43 and the flat portion 44, and the sterically shaped portion 43 and the flat portion 44 advances in the axial direction while spirally circulating.

(With Regard to Each Flow Path)

The first flow path 11 is defined by the bottom surface 12 that is composed of the inner peripheral surface of the outer tube 20, the two slopes of the first slope 13 and the second slope 14, and the peak portion 15 between the first slope 13 and the second slope 14. The peak portion 15 is composed of the flat portion 44, and the peak portion 15 is a linear peak portion having a length in the axial-direction cross sectional shape, but this may also be a dot-like apex having no length.

The second flow path 21 is defined by the bottom surface 22 that is composed of the outer peripheral surface of the inner tube 10, the two slopes of the first slope 23 and the second slope 24, and the peak portion 25 between the first slope 23 and the second slope 24. The peak portion 25 may be a dot-like apex having no length in the axial-direction cross sectional shape, or may be a linear peak portion having a length.

A plate-like flow path body 42 extending spirally is fixed to the inner peripheral surface of the third cylinder 30 by welding or the like, whereby the third flow path 31 becomes a spiral space. The circulation direction of the third flow path 31 may be the same as the circulation direction of the first flow path 11 and the second flow path 21, or may be different (for example, clockwise or counterclockwise direction).

(With Regard to the Inflow Portion and the Outflow Portion)

The outer tube 20, the third cylinder 30, and the heat transfer body 41 each have the bottom portion 28, the bottom portion 34, and a bottom portion 45, respectively; these portions having a dome-like shape. On the other hand, the inner tube 10 does not have such a dome-like bottom portion, and the bottom end thereof is fixed to the inner surface side of the bottom portion 45 of the heat transfer body 41 by welding or the like.

In the first flow path 11, the lower end thereof is connected to an outer flow path via the inflow portion 16. In this example, the inflow portion 16 is provided such that a connecting pipe is attached to a penetrating hole that is open to the bottom portion 28 of the outer tube 20.

The upper end of the first flow path 11 is connected to an outer flow path via the inflow portion 17. In this example, the inflow portion 17 is provided such that a connecting pipe is attached to a penetrating hole that is open to the flange portion 40. The first fluid F1 flows from the inflow portion 16 into the spiral first flow path 11 and moves spirally upward, and then flows out to outside through the outflow portion 17.

In the second flow path 21, the upper end thereof is connected to an outer flow path via the inflow portion 26. In this example, the inflow portion 26 is provided such that a connecting pipe having an L-shaped bending portion is attached to a penetrating hole that is open to the inner wall surface near the upper end side of the inner tube 10. The lower end of the second flow path 21 is connected to an outer flow path via the outflow portion 27. In this example, the outflow portion 27 is provided such that a connecting pipe having an L-shaped bending portion is attached to a penetrating hole that is open to the inner wall surface in the lower end side of the inner tube 10. Here, this connecting pipe having the bending portion is extended in a cylindrical space inside of the inner tube 10 until its position in the axial direction becomes substantially the same height as the inflow portion 26.

The second fluid F2 flows from the inflow portion 26 into the spiral second flow path 21 and moves downward while spirally circulating, and then flows out to outside through the outflow portion 27.

Next, in the third flow path 31, the upper end thereof is connected to an outer flow path via the inflow portion 32. In this example, the inflow portion 32 is provided such that a connecting pipe is attached to a penetrating hole that is open to the outer peripheral surface in the upper end side of the third cylinder 30. The lower end of the third flow path 31 is connected to an outer flow path via the outflow portion 33. In this example, the outflow portion 33 is provided such that a connecting pipe is attached to a penetrating hole that is open to the bottom portion 34 in the lower end side of the third cylinder 30. The third fluid F3 flows from the inflow portion 32 into the spiral third flow path 31 and moves downward spirally, and then flows out to outside through the outflow portion 33.

Note that, upon carrying out this embodiment, the inflow portion and the outflow portion of each flow path may be reversed.

(Separation of Cylinders)

When the heat exchanger is disassembled by releasing the joining made by means of the detachable joining members (not shown) such as the bolts of the upper and lower flange portions 40 and 40, this can be separated into the outer tube 20 to which the third cylinder 30 is joined, the inner tube 10, and the heat transfer body 41, so that the outer tube 20 to which the third cylinder 30 is joined can be pulled out to downward as shown in drawing together with the lower flange portion 40 in the drawing. By so doing, the first flow path 11 becomes the state of being separated into the inside and the outside thereof; and thus, the flow path constitution surface that defines the first flow path 11 is separated into the side of the inner tube 10 and the side of the outer tube 20. The flow path constitution surface that defines the first flow path 11 is the inner peripheral surface of the outer tube 20 on the side of the outer tube 20 and is the surface of the outer side of the heat transfer body 41 in the radius direction on the side of the inner tube 10. All of these surfaces are configured so as to be directly exposed without being hidden by any other portion when viewed from the radius direction that is perpendicular to the axial direction. Accordingly, similarly to the first embodiment, the first flow path 11 becomes in the state where cleaning is extremely easy.

In the first embodiment, the exterior angle $\theta_O$ was the angle formed by the sterically shaped portion 43 and the outer tube 20; but in this embodiment, the exterior angle $\theta_O$ is the angle formed by the sterically shaped portion 43 and the flat portion 44. In either case, since the exterior angle $\theta_O$ is an obtuse angle of 90 degrees or greater, in the separated state, they are released to the state where there is no narrow portion; therefore, not only the cleaning of the first flow path 11 can be done extremely easy, but also the cleaning state can be readily confirmed.

Figure 4:
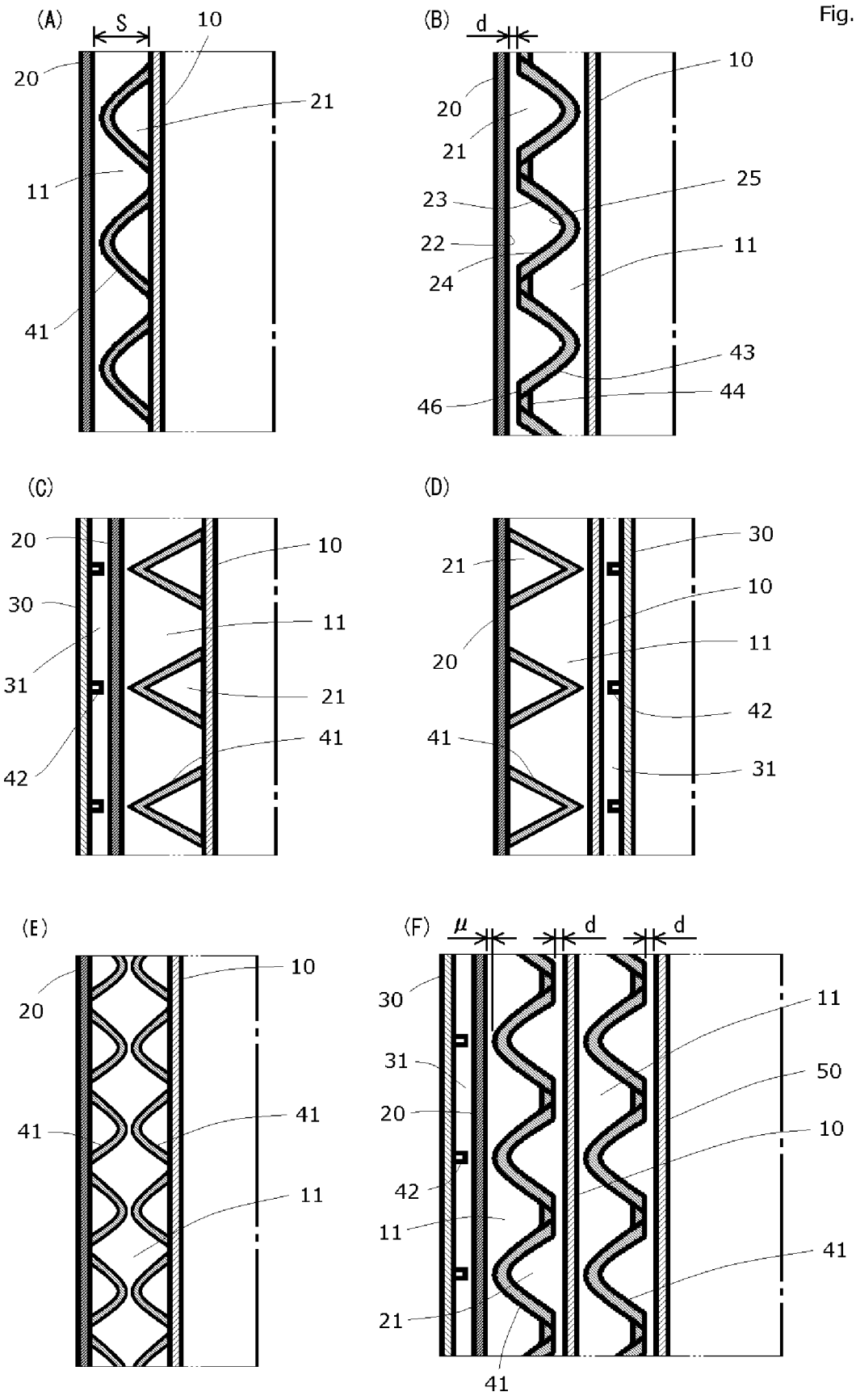
FIG. 4A to FIG. 4F each are a cross-sectional view in vertical direction of the essential part showing the modification examples of the heat exchanger according to the respective embodiments of the present invention.

(With Regard to FIG. 4)

The present invention may be carried out with various modification in addition to the above-mentioned embodiments. These modified examples will be explained with reference to FIG. 4.

The heat transfer body 41 may be arranged on the outer peripheral surface of the inner tube 10 as shown in FIG. 4A, or may be arranged on the inner peripheral surface of the outer tube 20 as shown in FIG. 4B. In addition, the heat transfer body 41 may be configured such that the sterically shaped portion 43 is fixed to the peripheral surface of the cylinder without providing the flat portion 44, or may be provided with the sterically shaped portion 43 and the flat portion 44 to form cylindrical shape as a whole.

As shown in FIG. 4A, a radius-direction width S in the space between the inner tube 10 and the outer tube 20 is preferably in the range of 4 mm to 75 mm, while more preferably in the range of 10 mm to 50 mm.

It may be said that FIG. 4B is a modification example of the second embodiment. In the second embodiment, the peak portion 25 of the heat transfer body 41 faces the outer peripheral surface of the inner tube 10; on the other hand, in this modification example, the peak portion 25 of the heat transfer body 41 faces the inner peripheral surface of the outer tube 20. In this example, a gap (d) is formed between the outer peripheral surface of the flat portion 44 of the heat transfer body 41 and the inner peripheral surface of the outer tube 20; in other words, a space is formed between the end side 46 of the sterically shaped portion 43 and the inner peripheral surface of the outer tube 20. The embodiment may be carried out without such a gap (d); but it is appropriate that the gap (d) is 3 mm or less. In still other words, the gap (d) is formed between the circulations adjacent to each other in the axial direction in the spirally circulating second flow path, namely between the cross-sectional shape of the substantially triangle and the cross-sectional shape of the substantially triangle that are adjacent to each other in the axial direction. It may be carried out without providing such a gap (d); but when the gap (d) is provided, it is appropriate 3 mm or less in the radius direction. By forming this gap (d), while the second flow path 21 can be enlarged; when the gap is too large, the amount of the second fluid F2 that does not spirally flow but flows in a short pass in the axial direction increases, so that the efficiency of the heat exchange may be decreased.

Next, the third cylinder 30 may be arranged in the outer side of the outer tube 20 and fixed thereto as shown in FIG. 4C, or may be arranged in the inner side of the inner tube 10 and fixed thereto as shown in FIG. 4D, or only the first flow path 11 and the second flow path 21 may be arranged without providing a third cylinder 30.

As shown in FIG. 4E, two sets of the heat transfer bodies 41 may be used. In this case, it can show that one heat transfer body 41 is fixed to the outer peripheral surface of the inner tube 10, and the other heat transfer body 41 is fixed to the inner peripheral surface of the outer tube 20. When the space between the two sets of the heat transfer bodies 41 and 41 constitute the first flow path 11 through which the first fluid F1 flows, upon separating the inner tube 10 from the outer tube 20, the first flow path 11 becomes the state of being separated into two portions of the inside and the outside, so that the flow path constitution surface that defines the first flow path 11 is separated into the side of the inner tube 10 and the side of the outer tube 20. In the flow path constitution surface that defines the first flow path 11, the side of the outer tube 10 is the surface of the inner side of the heat transfer body 41 in the radius direction, and the side of the inner tube 20 is the surface of the outer side of the heat transfer body 41 in the radius direction. These surfaces are configured so as to be directly exposed without being hidden by any other portion when viewed from the radius direction that is perpendicular to the axial direction.

The space between the one heat transfer body 41 and the inner tube 10 and the space between the other heat transfer body 41 and the outer tube 20 constitute the second flow path and the third flow path, respectively. In FIG. 4E, the two sets of the heat transfer bodies 41 are arranged such that the peak portions of the substantially triangles in the axial-direction cross-sectional view face each other; although the pitches of both sides may be shifted.

FIG. 4F shows the modification example of the second embodiment. Here, a fourth cylinder 50 is concentrically arranged further inside of the inner tube 10, and the heat transfer body 41 may be arranged in the space between the inner tube 10 and the fourth cylinder 50, therefore, a plurality of the heat transfer bodies 41 can be arranged. In the inner tube 10 and the fourth cylinder 50 concentrically thus arranged, when viewed from a relation of the inside and outside in the radius direction, the inner tube 10 is arranged in the outer side of the fourth cylinder 50, and the fourth cylinder 50 is arranged in the inner side of the inner tube 10, thus the inner tube 10 corresponds to the outer tube 20, and the fourth cylinder 50 corresponds to the inner tube 10. Accordingly, in FIG. 4F, there are concentrically two spaces formed between the inner tube 10 and the outer tube 20 which are concentrically arranged, as the result, a plurality of the spaces formed between the inner tube and outer tube which are concentrically arranged may be arranged concentrically.

As described above, in any of the examples, the side of the inner tube 10 and the side of the outer tube 20 have a configuration that can be assembled such that they can be separated only by moving in the axial direction (upward and downward directions) without rotating; and here, the heat transfer body 41 has the size not intervening other portions when moving in the axial direction (upward and downward directions). Specifically, in the case of the inner tube 10 and the outer tube 20 having a constant circular cylindrical shape with the radius, when the heat transfer body 41 is fixed to the side of the inner tube 10, the maximum outer diameter of the heat transfer body 41 is set so as to be smaller than the inner diameter of the outer tube 20. Also, when the heat transfer body 41 is fixed to the side of the outer tube 20, the minimum inner diameter of the heat transfer body 41 is set so as to be larger than the outer diameter of the outer tube 20. In addition, the present invention may also be carried out as a substantially cone shape whose radius changes as the inner tube 10 and the outer tube 20 move in the axial direction. In this case, assuming that the inner tube 10 can be separated from the outer tube 20 by moving this upward in the drawing, when the heat transfer body 41 is fixed to the side of the inner tube 10, the maximum outer diameter of the heat transfer body 41 in each cross section that is perpendicular to the axial direction is set so as to be smaller than the inner diameter of the outer tube 20 that is above the cross section. When the heat transfer body 41 is fixed to the side of the outer tube 20, the minimum inner diameter of the heat transfer body 41 in each cross section that is perpendicular to the axial direction is set so as to be larger than the outer diameter of the inner tube 20 that is above the cross section.

REFERENCE NUMERALS

F1 First fluid
F2 Second fluid
F3 Third fluid
10 Inner tube
11 First flow path
12 Bottom surface
13 First slope
14 Second slope
15 Peak portion
16 Inflow portion
17 Outflow portion
18 Bottom portion

20 Outer tube
21 Second flow path
22 Bottom surface
23 First slope
24 Second slope
25 Peak portion
26 Inflow portion
27 Outflow portion
28 Bottom portion
30 Third cylinder
31 Third flow path
32 Inflow portion
33 Outflow portion
34 Bottom portion
40 Flange portion
41 Heat transfer body
42 Flow path body
43 Sterically shaped portion
44 Flat portion
45 Bottom portion
λ Maximum flow path width of the first flow path
μ Gap (minimum flow path width of the first flow path)
d Gap

The invention claimed is:

1. A heat exchanger comprising:
a first tube;
a second tube, the second tube being concentric with the first tube;
a first flow path and a second flow path, each of the first flow path and the second flow path extending spirally in a space formed between the first tube and the second tube,
wherein a heat exchange is performed between a first fluid flowing through the first flow path and a second fluid flowing through the second flow path via a heat transfer body,
wherein at least any one of the first tube and the second tube is a cylinder having a circular cross section,
wherein the heat transfer body is spirally attached to the first tube to form the second flow path between the heat transfer body and the first tube,
wherein flights of the heat transfer body are spaced from each other so that the first tube forms part of the first flow path, and
wherein the space is partitioned into the first flow path and the second flow path by the heat transfer body.

2. The heat exchanger according to claim 1, wherein the first flow path and the second flow path are not provided with a portion extending in only a radial direction.

3. The heat exchanger according to claim 1, wherein the heat transfer body contacts the second tube, or a gap of 4 mm or less in a radial direction is formed between the heat transfer body and the second tube.

4. The heat exchanger according to claim 1, wherein a cross sectional in an axial-direction of the heat transfer body is a substantial triangle whose apex angle θ is in the range of 30 degrees to 125 degrees.

5. The heat exchanger according to claim 1, wherein the heat transfer body in an axial direction cross section has two slopes, and a peak portion extending between the two slopes, and
wherein an axial-direction length of the peak portion is shorter than an axial-direction length of the slopes.

6. The heat exchanger according to claim 1, wherein at least any one of the first flow path and the second flow path is coated with a corrosion resistant material.

7. The heat exchanger according to claim 6, wherein the coating with the corrosion resistant material is one of a glass lining, a fluorine resin coating, and a ceramic coating.

8. The heat exchanger according to claim 1, wherein the first tube is an inner tube and the second tube is an outer tube.

9. A heat exchanger comprising:
a first tube;
a second tube, the second tube being concentric with the first tube;
a heat transfer body spirally extending in a space formed between the first tube and the second tube, the space being partitioned into a first flow path and a second flow path by the heat transfer body,
wherein a heat exchange is performed between a first fluid flowing through the first flow path and a second fluid flowing through the second flow path via the heat transfer body,
wherein the heat transfer body is spaced from the first tube,
wherein the first flow path is formed between the heat transfer body and the first tube, and a flow path width is defined by a distance between the heat transfer body and the first tube in a radial direction;
wherein the first flow path is a spirally extended flow path, and
a ratio (λ/μ) of a maximum flow path width (λ) of the first flow path to a minimum flow path width (μ) of the first flow path.

10. The heat exchanger according to claim 9, wherein the heat transfer body is spaced from the second tube, and the heat transfer body is provided with a portion that has at least one bending portion and can define a space in which fluids can flow in both an inner surface side and an outer face side thereof, and
wherein an exterior angle of the at least one bending portion is 90 degrees or more.

11. The heat exchanger according to claim 9, wherein the first flow path and the second flow path are not provided with a portion extending in only a radial direction.

12. The heat exchanger according to claim 10, wherein the first flow path and the second flow path are not provided with a portion extending in only a radial direction.

13. The heat exchanger according to claim 9, wherein a gap of 4 mm or less in a radial direction is formed between the heat transfer body and the first tube.

14. The heat exchanger according to claim 10, wherein a gap of 4 mm or less in a radial direction is formed between the heat transfer body and the first tube.

15. The heat exchanger according to claim 2, wherein the heat transfer body contacts the second tube, or a gap of 4 mm or less in a radial direction is formed between the heat transfer body and the second tube.

16. The heat exchanger according to claim 9, wherein a cross sectional in an axial-direction of the heat transfer body is a substantial triangle whose apex angle θ is in the range of 30 degrees to 125 degrees.

17. The heat exchanger according to claim 10, wherein a cross sectional in an axial-direction of the heat transfer body is a substantial triangle whose apex angle θ is in the range of 30 degrees to 125 degrees.

18. The heat exchanger according to claim 2, wherein a cross sectional in an axial-direction of the heat transfer body is a substantial triangle whose apex angle θ is in the range of 30 degrees to 125 degrees.

19. The heat exchanger according to claim 9, wherein the first tube is an inner tube and the second tube is an outer tube.

* * * * *